United States Patent [19]

Van Sickle

[11] 4,450,772

[45] May 29, 1984

[54] TENDER-MOUNTED SOUND SYSTEM FOR TOY STEAM LOCOMOTIVE

[75] Inventor: James R. Van Sickle, New Baltimore, Mich.

[73] Assignee: CPG Products Corp., Minneapolis, Minn.

[21] Appl. No.: 343,126

[22] Filed: Jan. 27, 1982

[51] Int. Cl.[3] ..... A63H 17/34; B60L 1/00

[52] U.S. Cl. ..... 104/295; 46/232; 104/296; 104/DIG. 1; 105/1 T

[58] Field of Search ..... 46/113, 227, 232; 104/295, 296, DIG. 1; 105/1 T, 49

[56] References Cited

U.S. PATENT DOCUMENTS

| | | | |
|---|---|---|---|
| 1,889,918 | 12/1932 | Howser, Jr. | 46/232 |
| 3,466,797 | 9/1969 | Hellsund | 46/232 |
| 3,664,060 | 5/1972 | Longnecker | 46/232 |
| 3,839,822 | 10/1974 | Rexford | 46/232 |
| 4,266,368 | 5/1981 | Nyman | 46/232 |

FOREIGN PATENT DOCUMENTS

| | | | |
|---|---|---|---|
| 2736860 | 3/1979 | Fed. Rep. of Germany | 46/232 |
| 2063692 | 6/1981 | United Kingdom | 46/232 |

*Primary Examiner*—Robert B. Reeves
*Assistant Examiner*—David F. Hubbuch
*Attorney, Agent, or Firm*—Gene O. Enockson; L. MeRoy Lillehaugen; Stuart R. Peterson

[57] ABSTRACT

The sound-of-steam producing system is completely mounted on the tender intended to be pulled by a toy electric locomotive. The system includes a switch mechanism included in the circuit of a module which energizes a speaker to simulate the puffing sound of a real locomotive. The switch mechanism is opened and closed by a roller mechanism comprising a pair of rollers having their diameters ratioed in accordance with the relative diameters of the locomotive's drive wheels and the tender's wheels, whereby the puffing sound is precisely synchronized with the rotation of drive wheels of the locomotive.

12 Claims, 10 Drawing Figures

TENDER-MOUNTED SOUND SYSTEM FOR TOY STEAM LOCOMOTIVE

BACKGROUND OF THE INVENTION

1. Field of the Invention

This invention relates generally to model railroads, and pertains more particularly to a toy steam locomotive and tender, the tender having a sound-of-steam generating system integral therewith.

2. Description of the Prior Art

U.S. Pat. No. 2,317,974, issued on May 4, 1943 to Otto Bastiansen, for "Pseudo Steam Puffing Apparatus for Toy Trains", describes a coal-carrying tender for a toy steam locomotive in which the puffing sound producing system is contained completely in the tender. The patent recognizes the desirability of having the simulated puffing sounds produced in a timed relation to the moving performance of the locomotive. In an attempt to achieve the timed relation, the patentee employs an electric sound accessory motor in addition to the electric traction motor, relying upon the particular voltage impressed on each motor to produce a correlation between the puffing sounds and the movement of the locomotive. Stated somewhat differently, since both the traction motor and the sound producing motor tend to run faster under high voltage conditions and more slowly under low voltage conditions, the frequency of puffs is intended to be in a proportional relationship to the speed at which the locomotive is traveling by reason of having the same voltage applied to each motor. There is only a proportional relationship between the movement of the locomotive and the rate at which puffing sounds are generated; there is not a synchronized relationship between the actual rotation of the driving wheels of the locomotive and the puffing sounds. In other words, even when the same voltage is applied to each motor, one motor can "run" faster than the other. Consequently, there can be more sound puffs or fewer puffs per unit of time than needed to produce synchronized relation with the wheel rotation.

Because the sound should be in a truly synchronized or direct relation with the rotation of the locomotive's drive wheels, contact closure has customarily been realized via a contactor mechanism operated directly from the drive wheels on the toy locomotive. In such situations, a set of contacts are closed each time the drive wheels make a revolution. Inasmuch as, for space reasons, the sound generating apparatus is located on the tender, it is necessary to electrically connect the tender to the locomotive through appropriate wiring and connectors. While this provides the desired timed relation, it does require extra wiring on the toy locomotive, as well as having the contactor or interruptor on the locomotive.

U.S. Pat. No. 3,839,822 granted on Oct. 8, 1974 to Willis Ernest Rexford for "Model Train Sound Simulator" achieves a puffing sound synchronized with the rotation of the drive wheels of the locomotive, and also provides a sound system that is completely contained on the tender. To obtain these results, the patentee in this particular instance makes use of a rather complicated wheel having the same diameter as the driving wheels on the locomotive to which the tender is to be coupled, the "extra" wheel being rotatively mounted beneath the tender so that it rides along the center rail of the track.

SUMMARY OF THE INVENTION

One object of my invention is to provide a tender in which the entire sound-of-steam producing system is mounted thereon which system is less costly than the systems hereinbefore alluded to.

Another object is to provide a system for producing intermittent puffing sounds that is not only integral with the tender behind the locomotive, but which is extremely simple as far as its construction is concerned.

A further object is to provide a sound producing system that is not only completely contained in the tender, but which is rugged and reliable as well.

Yet another object of the invention is to provide a tender having mounted thereon the entire puffing sound generating system which will have a realistic appearance in contradistinction to a tender having an extra wheel therebeneath.

Briefly, my invention contemplates a toy locomotive having larger diameter driving wheels than those on the trailing tender. Inasmuch as the smaller wheels on the tender will rotate at a faster rate than the larger wheels on the locomotive, in order to provide the desired degree of synchronized puffing sound, I employ a switch mechanism in circuit with a conventional sound-of-steam module which circuit is opened and closed by means of a speed reduction mechanism having a reduction ratio that inversely corresponds with the ratio of the diameter (or circumference) of the drive wheels on the toy locomotive to the diameter of the tender wheels. In this way, I very effectively and inexpensively achieve an exact relationship between the generation of puffing sounds and the rate at which the drive wheels on the locomotive rotate, thereby producing an extremely realistic puffing sound simulation.

DESCRIPTION OF THE PREFERRED EMBODIMENT

Figure 1:
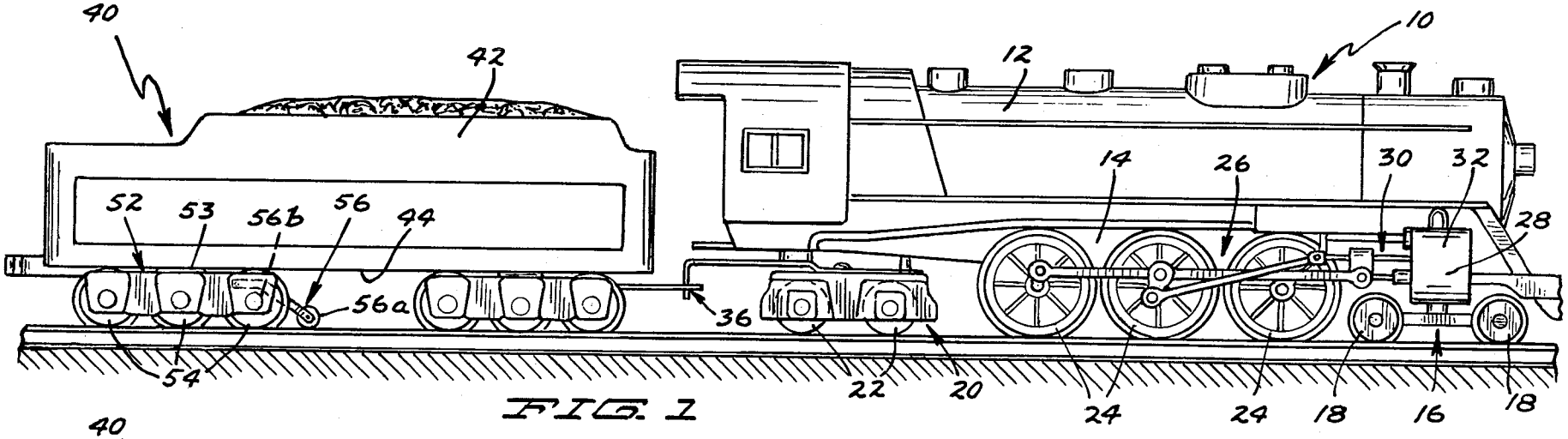
FIG. 1 is a side elevation of a toy locomotive and tender, the tender having a self-contained system thereon for generating puffing sounds.

As illustrated in FIG. 1, a toy steam locomotive denoted generally by the reference numeral 10 has been illustrated. Typically, it includes a body or shell 12 which is a replica of a particular type of locomotive common to a given era, the body 12 being carried on a chassis 14. There is a pilot truck 16 beneath the forward end of the chassis 14 having relatively small wheels 18, and a trailer truck 20 at the rear of the chassis 14 also having relatively small wheels 22.

Intermediate the pilot truck 16 and the trailer truck 20 are three pairs of laterally spaced metal drive wheels 24. A simulated drive mechanism 26 has been shown, being associated with a steam chest labeled 28. To complete the realism of the locomotive 10, there is pictured a control mechanism 30 actuated through the agency of a slide-valve chest 32.

Figure 2:
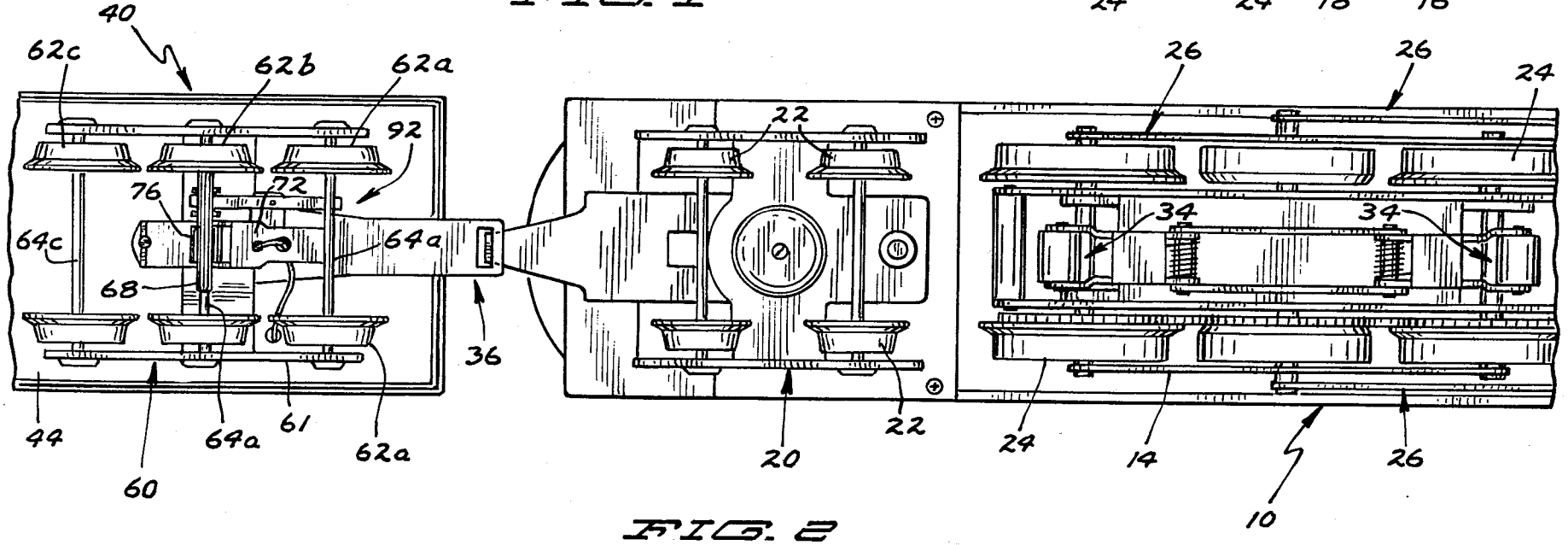
FIG. 2 is a bottom plan view on a larger scale of portions of the locomotive and tender.
Figure 3:
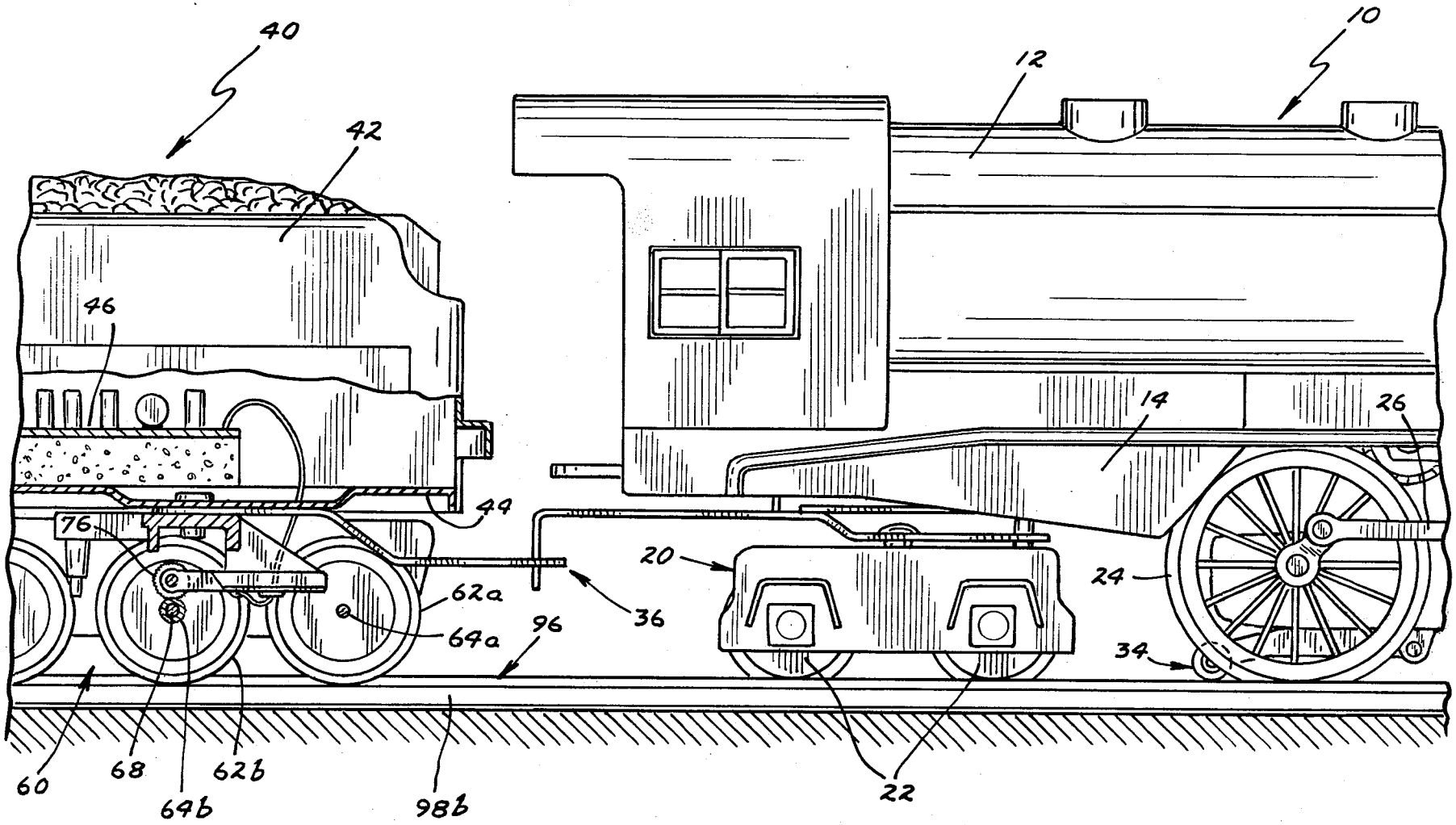
FIG. 3 is a fragmentary side elevational view showing the rear portion of the toy locomotive and the forward portion of its tender, a portion of the tender body or shell being broken away.
Figure 5:
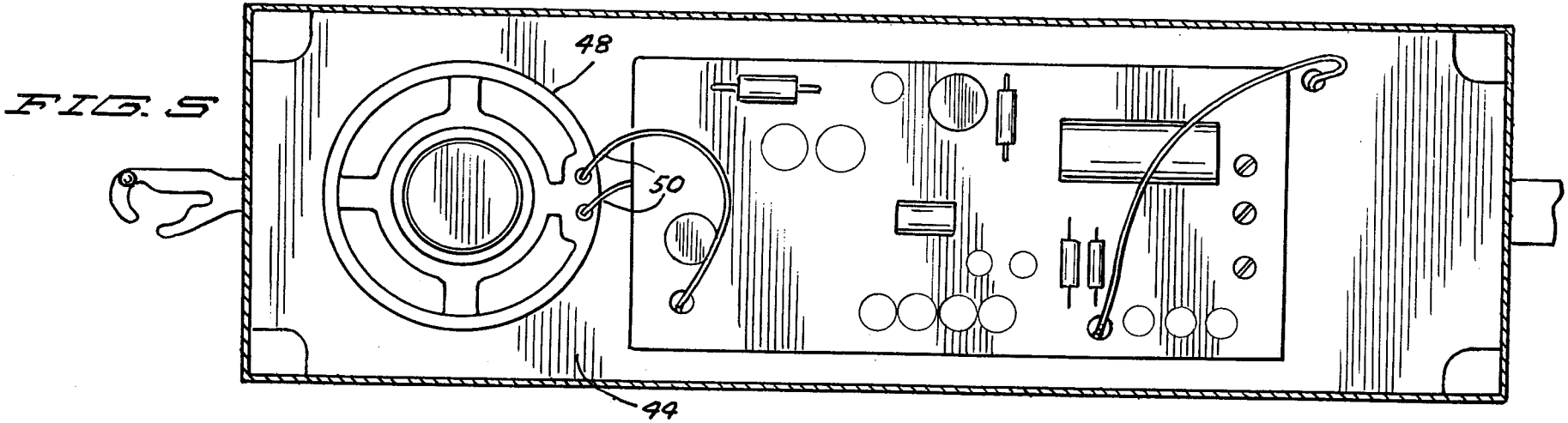
FIG. 5 is a plan view taken in the direction of line 5—5 of FIG. 4.
Figure 4:
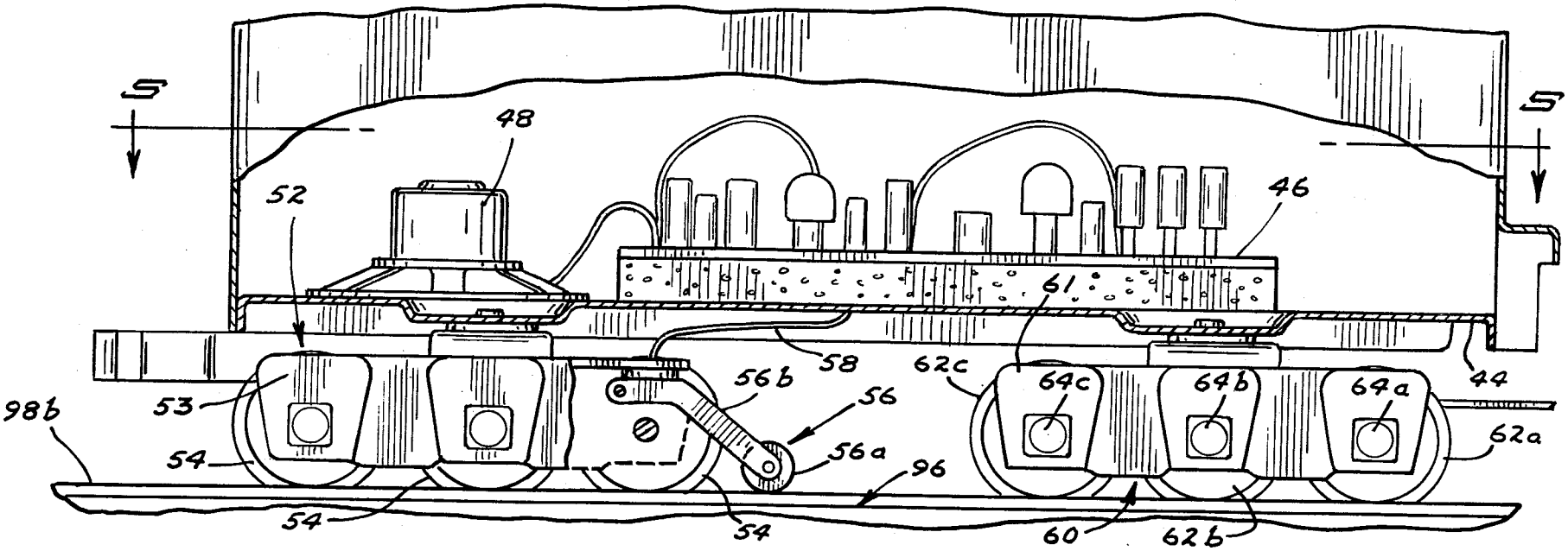
FIG. 4 is a side elevational view of just the tender, a portion of the tender's body or shell being removed in this instance in order to illustrate the presence of a conventional sound-of-steam module and the speaker connected thereto.

Still further, as can best be discerned from FIG. 2, the toy locomotive 10 is equipped with centrally disposed roller pickups 34. The circuit, it is to be understood, for the traction motor (not shown) is housed within the body 12 and is completed via the drive wheels 24 and the pickups 34.

A typical coupler 36 connects the locomotive 10 to a coal tender 40 having a body or shell 42 which is carried on a chassis 44. It is the coal tender 40 that has mounted thereon a complete puffing sound producing system 45 which comprises a sound-of-steam module 46 that is electrically connected to a speaker 48 via wires 50. The module or generator 46 is of conventional construction; it not only produces puffing sounds, but also contains electrical components capable of emitting a whistle-resembling sound as well. However, the present invention is concerned only with the sound-of-steam generating capability.

The tender 40 includes a rear truck 52 swivelly mounted beneath the chassis 44. The truck 52 includes a frame 53 on which three pairs of relatively small metal wheels 54 are rotatably journalled. A roller pickup 56 is carried by the rear truck 52; basically, the roller pickup 56 is the same as either of the earlier-alluded to pickups 34. In this regard, the roller pickup 56 includes a roller 56*a* journaled at the lower or free end of a spring loaded pivotal arm 56*b*, the arm being biased in an angular direction such that the roller 56*a*, at its free end, is urged downwardly. A flexible conductor or wire 58 connects the roller pickup 56 to the sound-of-steam module or generator 46.

The tender 40 also includes a forward truck 60 which includes a frame 61 to which a number of pairs of laterally spaced metal wheels 62*a*, 62*b* and 62*c* are rotatably mounted by means of transverse metal axles 64*a*, 64*b* and 64*c*.

Of importance in practicing my invention is a speed reduction mechanism indicated generally by the reference numeral 66. The mechanism 66 includes a knurled drive roller 68 of dielectric material, preferably a suitable elastomer, which encircles the shaft 64*b*, the drive roller 68 being actually fastened to the axle 64*b* so that it rotates in unison therewith.

At this time, attention is directed to a support block 70 which is attached to the truck frame 61. The block 70 supports a metal plate or blade 72 having laterally spaced ears 73 integral therewith. In practice, the plate or blade 72 is copper and is fastened to the underside of the block 70 by means of a tubular rivet 74. A flexible conductor or wire 75 connects the plate or blade 72 to the module 46.

Rotatably carried on the plate or blade 72 is a knurled driven roller 76 having a larger diameter than the knurled drive roller 68 and preferably of the same elastomeric material. The driven roller 76 is rotatably mounted on a shaft 78 that projects through the ears 73, a pair of metal eyelets 79 serving as bearings. Inasmuch as the drive wheels 24 on the locomotive 10 are of larger diameter than the wheels 62*a*, 62*b* and 62*c* on the forward truck 60 of the tender 40, it can be stated at this point that the diameters (or circumferences) of the rollers 68, 76 are selected so as to provide an exact reduction ratio that is inversely proportional to the ratio between the diameters (or circumferences) of the wheels 24 with respect to the wheels 62*a*, 62*b* and 62*c*. For instance, where the diameter of the drive wheels 24 is 1.25 inches, and the diameter of the tender wheels 62*a*–62*c* is 0.725 inch, then a ratio of 1.71:1.00 would be employed between the rollers 68 and 76 so that the driven roller 76 would be rotated at the precise rotation rate as the drive wheels 24.

Directly associated with the reduction mechanism 66 is a switch mechanism indicated generally by the reference numeral 80. The switch mechanism 80 includes a contactor sleeve 82 having a semicircular cam portion 84 providing an opening at 86 which exposes a segment of the metal shaft 78.

There is a lateral extension 88 on the truck frame 61. Extending through the extension 88 is a tubular rivet 90, the tubular rivet holding a resilient metal strip 92 in place. More specifically, the strip 92, which is preferably of copper, includes a central portion 94*a* having a hole through which the rivet 90 passes, a forwardly extending integral leaf spring portion 94*b* which pressurally bears against the axle 64*a*, and a rearwardly extending integral leaf spring portion 94*c* which pressurally bears against the cam 84 of the contactor sleeve 82 and against the shaft 78 whenever the opening 86 is rotated into juxtaposition therewith.

It is intended that the toy locomotive 10 and the tender 40 coupled thereto be operated on a conventional track indicated generally by the reference numeral 96. As is typical, the track 96 includes a center rail 98*a* and two outer rails 98*b*, 98*c*. The transformer for energizing the track has not been shown. However, it is conventional to connect one side of a transformer secondary to the center rail 98*a* which completes a circuit to the locomotive 10 via the two roller pickups 34. After passing through the electric motor contained in the body 12 of the locomotive 10, the return path for the current is through the drive wheels 24 and the outer rails 98*b*, 98*c* of the track 96. In the past, a single wire or conductor has extended rearwardly to a typical toy tender. The wire was previously employed to electrically connect the sound-of-steam module 46 to the center rail 98*a* through a circuit interrupter carried directly on the toy locomotive and actuated by the locomotive drive wheels, doing so through a center rail pickup, such as the rollers 34. The other side of the module was electrically connected to the outer rails 98*b*, 98*c* through the wheels of the tender, such as those labeled 54 and 62. However, the present invention obviates the need for any wires or conductors leading rearwardly from the locomotive 10 for supplying power to any electrically operated device mounted on the tender 40.

Operation

Having presented the foregoing information, it is believed that the invention can be readily understood from what has been presented. Nonetheless, in order to appreciate fully the benefits to be derived from use of my invention, a brief operational description will now be given. It should be borne in mind, though, that the module 46 is conventional. It produces intermittent puffing sounds and customarily includes the capability of producing whistle sounds as well, although the latter is not a feature of the present invention. The present invention is directly concerned with the providing of realistic puffing sounds in a direct timed relationship with the rotation of the drive wheels 24 on the locomotive 10. Since the drive wheels 24 are rotated in relation to the drive mechanism 26, the puffing signals are also in accordance with the moving parts constituting the drive mechanism 26.

In order to simulate an actual locomotive and tender, the drive wheels 24 on the toy locomotive 10 are considerably larger than the wheels 54 and 62 on the tender 40.

It is the function of the roller mechanism 66 to provide a result involving a precise ratio between the diameters of the tender wheels 62 and the drive wheels 24. In this regard, the relative diameters (or circumferences) of the rollers 68 and 76 are inversely proportional to the diameters (or circumferences) of the drive wheels 24 and the wheels **62*a*, 62*b* and 62*c* (and also 54 inasmuch as the wheels 54 are the same size as the wheels 62). Stated in another way, the ratio of the diameter of the roller 76 to the diameter of the roller 68 is equal to the ratio of the diameter of the drive wheels 24 to the diameter of the tender wheels 62*b* (and also the wheels 54, 62*a*, 62*b***).

Figure 7:
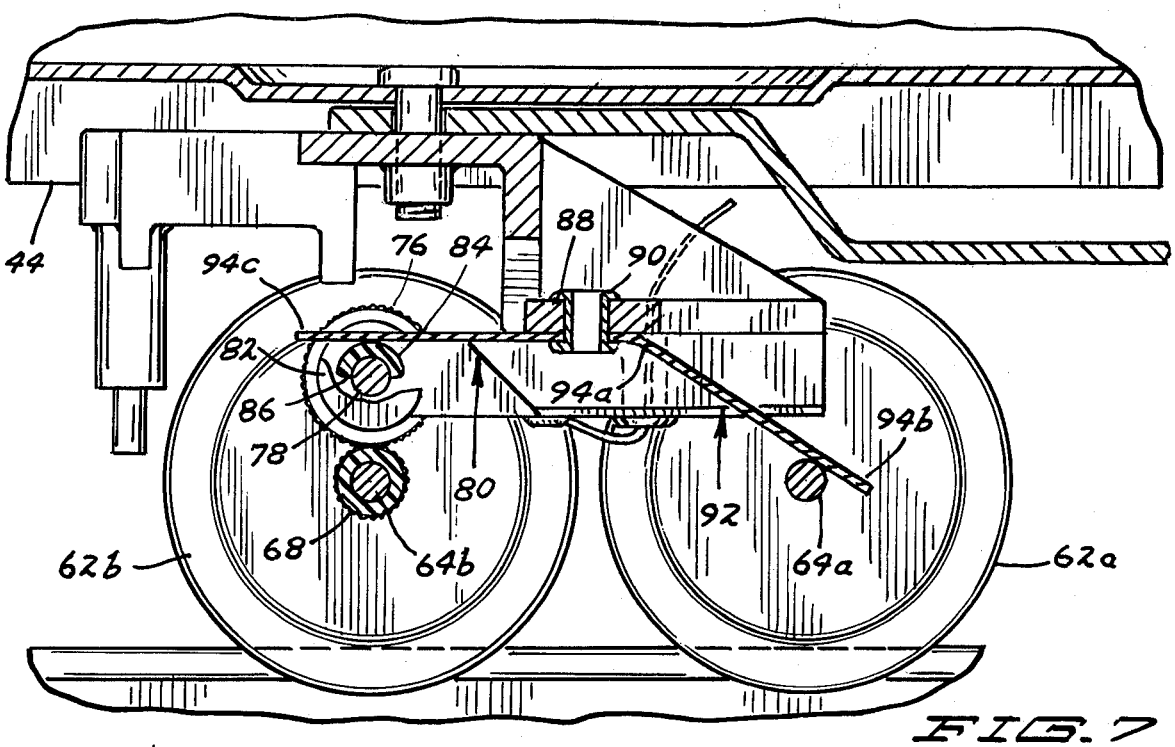
FIG. 7 is a sectional view taken in the direction of line 7—7 of FIG. 6.
Figure 6:
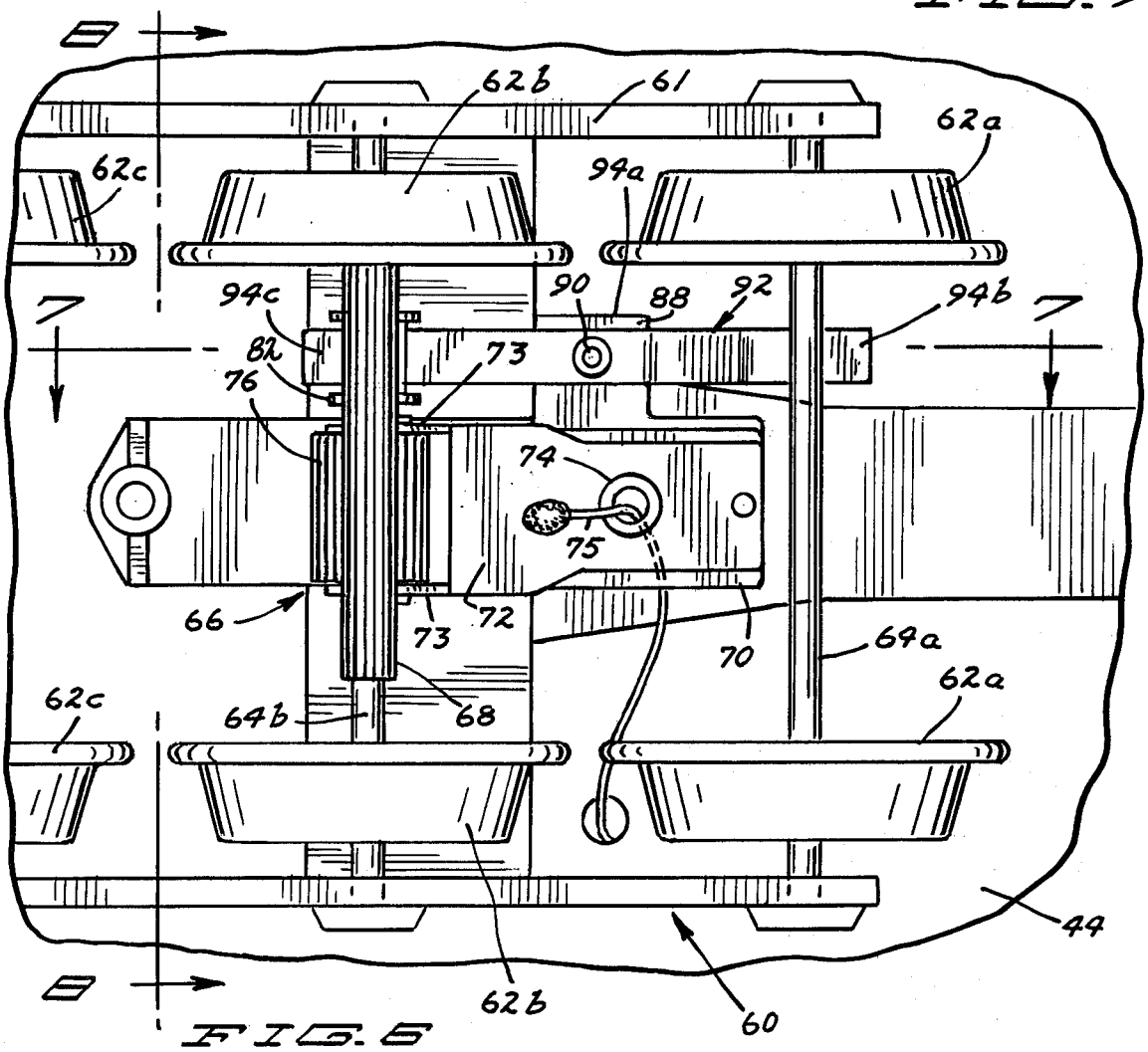
FIG. 6 is a bottom plan view of the major portion of the forward truck of the tender, the view depicting structure exemplifying my invention.
Figure 8:
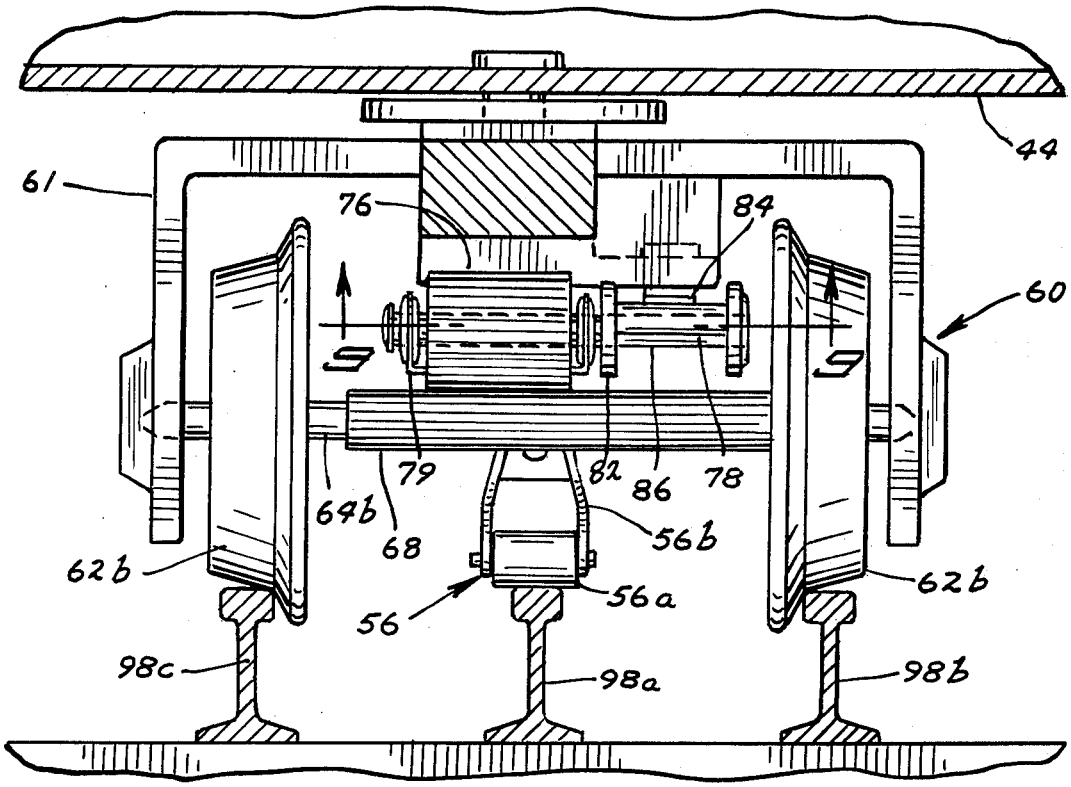
FIG. 8 is a sectional view taken in the direction of line 8—8 of FIG. 6.
Figure 9:
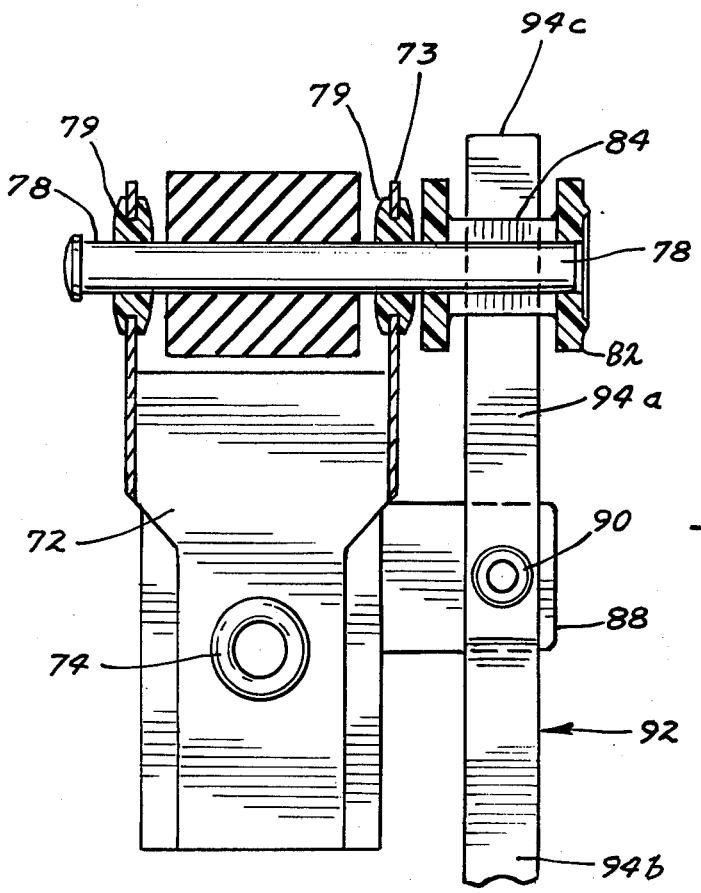
FIG. 9 is a horizontal sectional view taken in the direction of line 9—9 of FIG. 8.

Consequently, it is the function of the roller mechanism 66 to provide synchronized rotation between the drive wheels 26 and the driven roller 76. Inasmuch as the roller 76 is fixedly mounted on the shaft 78, and the diameters of the rollers 68, 76 properly selected, it follows that the rotation of the shaft 78 is in unison with the rotation of the drive wheels 26. Inasmuch as the contactor sleeve 82 of the switch mechanism 80 is mounted on the same shaft 78 as the roller 76, the contactor sleeve 82 is also rotated in exact synchronism with the drive wheels 26. Therefore, the cam 84, being a part of the sleeve 82, reaches the twelve o'clock position (as shown in FIG. 7) once each revolution of the roller 76. The exposed segment of the shaft 78, on which the cam 84 is mounted, also reaches the twelve o'clock position once for each revolution of the drive wheels 26 (but obviously 180 degrees out of phase with the cam 84).

From FIG. 7, it will be discerned that the leaf spring portion **94*c* is at this time raised so that it does not have electrical engagement with the shaft 78. It will be understood, however, that when the cam 84 moves from its twelve o'clock position in which it appears in FIG. 7 to the six o'clock position of this figure, then the leaf spring portion 94*c* contacts the shaft 78 so as to complete an electrical circuit through the shaft 78 to the laterally spaced wheels 62*a* and hence the outer rails 98*b* and 98*c* of the track 96, doing so through the portions 94*b*, 94*a* and 94*c* of the strip 92**.

Figure 10:
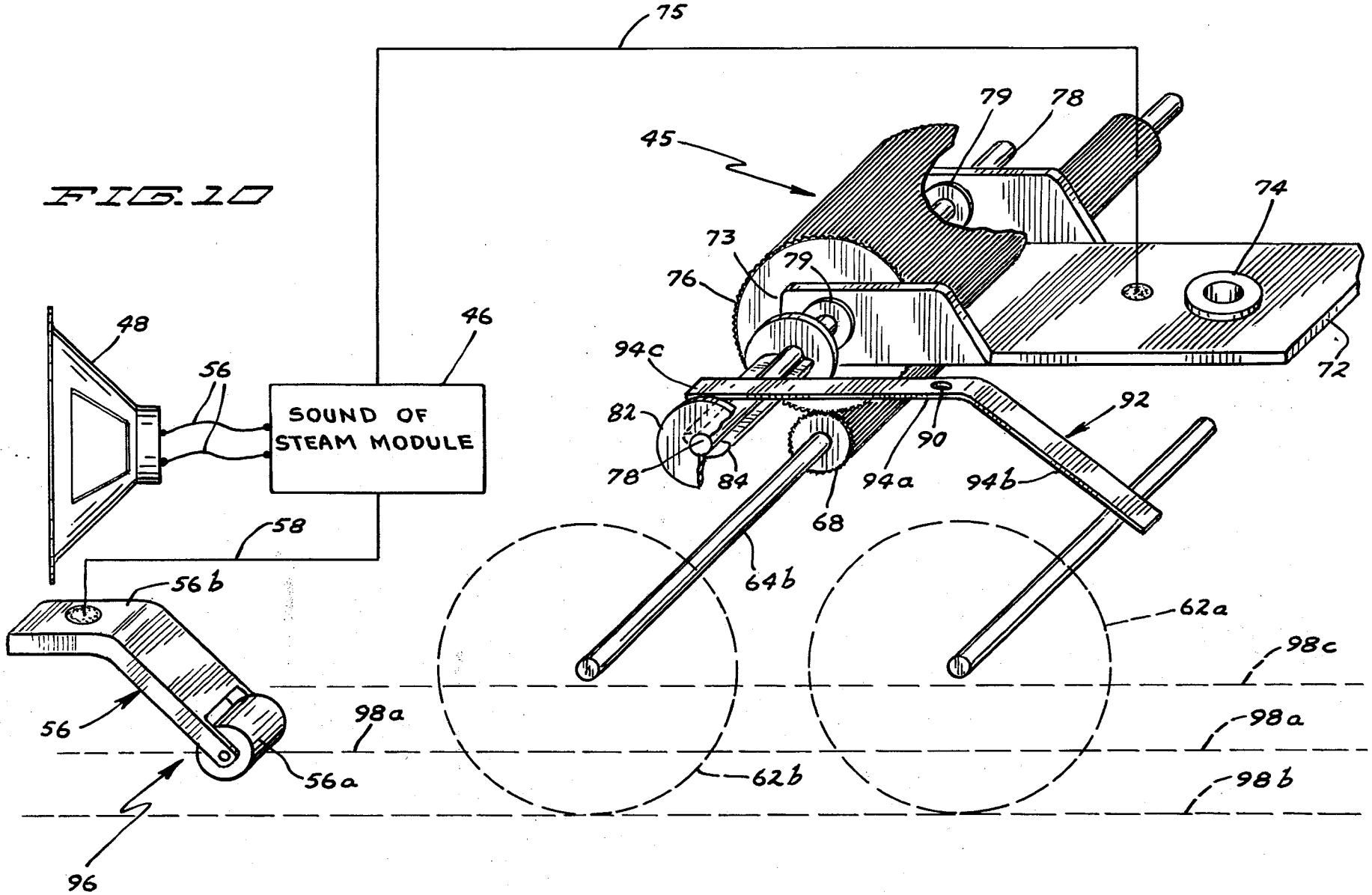
FIG. 10 is a diagrammatic representation, parts being shown in perspective and parts being depicted in phantom outline, which view is designed to facilitate an understanding of my invention.

The electrical path just described can perhaps be more readily understood from FIG. 10 wherein the leaf spring portion **94*c* is shown in contact with the shaft 78. Although understandable from FIGS. 6–9, the circuit path now being described can perhaps be more readily traced by continued reference to FIG. 10. Hence, it will be recognized that the shaft 78, which has the copper plate or blade 72 mounted thereon by means of the laterally spaced ears 73, provides an electrical connection to the module 46 through the conductor 75. The module 46, it will be appreciated, is connected via the connector 58 to the roller pickup 56 mounted on the rear truck 52 of the tender 40**.

Recapitulating, it follows that with the roller **56*a* in engagement with the center rail 98*a* of the track 96, there is a circuit from the center rail 98*a* through the module 46, the blade 72, the shaft 78, the metal strip 92, the shaft 64*a* and the wheels 62*a* to the outer rails 98*b*, 98*c*. Consequently, when these conditions prevail, the module 46 is energized and the speaker 58** emits a hissing-like puffing sound.

As already stated, when the cam 84 raises the leaf spring portion **94*b* of the strip 92, then the circuit described immediately above is interrupted or broken with the consequence that the module 46, under these conditions, is de-energized. It is when the leaf portion 94*b* is permitted to flex against the shaft 78 that the module is energized. Thus, there is a repeated opening and closing of a circuit containing the module 46 therein, all in precise synchronism with the rotation of the drive wheels 24 of the locomotive 10**.

I claim:

1. In combination, a toy steam locomotive comprising first wheel means including at least one pair of laterally spaced wheels of one diameter, a tender for said locomotive including second wheel means including at least one pair of laterally spaced wheels of another diameter, sound generating means carried on said tender, switch means in circuit with said sound generating means, and means mechanically connected to said second wheel means for opening and closing said switch means to energize and de-energize said sound generating means in a synchronized relation with the rotation of said first wheel means, said means for opening and closing said switch means including a first rotatable member of one diameter and a second rotatable member of another diameter, the ratio of said last-mentioned diameters being inversely proportional to the ratio of the diameters of said first and second wheel means.

2. The combination of claim 1 in which the diameter of the laterally spaced wheels of said first wheel means is larger than the diameter of the laterally spaced wheels of said second wheel means.

3. The combination of claim 2 in which said first rotatable member constitutes a first roller and said second rotatable member constitutes a second roller.

4. The combination of claim 3 in which said switch means includes a cam rotatable in unison with said second roller and a resilient metal strip having a leaf spring portion engageable with said cam during each revolution of said second roller to cause de-energization of said sound generating means.

5. The combination of claim 4 including a metal shaft, said second roller and said cam being mounted on said shaft, said cam extending only part way around said shaft so that an energizing circuit is completed to said sound generating means when said leaf spring portion is permitted to contact a segmental portion of said shaft when said cam is in a rotated position to expose said segmental shaft portion.

6. The combination of claim 5 in which said tender includes first and second axles, said pair of laterally spaced wheels of said second wheel means being mounted on said first axle, an additional pair of laterally spaced wheels on said second axle, and said resilient metal strip including a second leaf spring portion bearing continuously against said second axle so as to complete said circuit through said second axle shaft and the laterally spaced wheels mounted thereon, at least said second axle and the wheels mounted thereon being of metal.

7. The combination of claim 6 including electrical pickup means beneath said tender, said electrical pickup means being electrically connected to said sound generating means so that a circuit is completed through said electrical pickup means, said sound generating means, said shaft, said resilient metal strip, said second axle and the wheels on said second axle.

8. The combination of claim 7 including track means, said track means including a center rail and a pair of outer rails, said one pair of laterally spaced wheels of said first wheel means being adapted to ride on said outer rails, said laterally spaced wheels on said second axle of said second wheel means also being adapted to ride on said outer rails, and said electrical pickup means being adapted to ride on said center rail.

9. A toy tender for connection to a toy steam locomotive, the tender comprising a sound-of-steam module, a first pair of laterally spaced wheels, a second pair of laterally spaced wheels, an axle on which said first laterally spaced wheels are mounted, an axle on which said second laterally spaced wheels are mounted, at least one of said second wheels and its said axle being of metal, a rotatable member of one diameter mounted on said first axle for rotation therewith, a second rotatable member having a different diameter engaged with said first rotatable member, a metal shaft, said second rotatable member being mounted on said shaft, a cam also mounted on said shaft, a resilient metal strip having one end portion engageable with said shaft when said cam is in one rotated position and separated from said shaft when said cam is in a second rotated position, another portion of said metal strip bearing against said second axle, and means electrically connecting said shaft to said sound-of-steam module, whereby a circuit is interrupted through said module when said cam engages said one end portion of said strip and a circuit is completed through said module when said one end portion is permitted to engage said shaft.

10. The toy tender of claim 9 in which said first and second rotatable members are rollers, each roller being of a dielectric material.

11. The toy tender of claim 10 in which said dielectric material is an elastomeric material.

12. The toy tender of claim 9 in which said first and second rotatable members are rollers, the ratio of the diameter of the first roller to the diameter of the second roller being equal to the ratio of the diameter of said first pair of wheels to the diameter of the drive wheels of the toy locomotive to which said tender is intended to be attached.

* * * * *